US011306673B1

(12) United States Patent
Dahodwala et al.

(10) Patent No.: US 11,306,673 B1
(45) Date of Patent: Apr. 19, 2022

(54) TRANSIENT SOOT MODEL SYSTEM AND CONTROL PROCESS

(71) Applicant: FEV North America, Inc., Auburn Hills, MI (US)

(72) Inventors: Mufaddel Z. Dahodwala, West Bloomfield, MI (US); Satyum Joshi, Farmington Hills, MI (US); Erik Koehler, Birmingham, MI (US); Michael Franke, Rochester Hills, MI (US)

(73) Assignee: FEV North America, Inc., Auburn Hills, MI (US)

( * ) Notice: Subject to any disclaimer, the term of this patent is extended or adjusted under 35 U.S.C. 154(b) by 0 days.

(21) Appl. No.: 17/318,100

(22) Filed: May 12, 2021

(51) Int. Cl.
*F02D 41/14* (2006.01)
*F02D 41/28* (2006.01)

(52) U.S. Cl.
CPC ..... *F02D 41/1466* (2013.01); *F02D 41/28* (2013.01); *F02D 2041/286* (2013.01); *F02D 2200/0602* (2013.01); *F02D 2200/101* (2013.01); *F02D 2200/1002* (2013.01)

(58) Field of Classification Search
CPC ..... F02D 41/1466; F02D 41/28; F02D 2200/1002; F02D 2200/0602; F02D 2200/101; F02D 2041/286
USPC ..... 123/436, 672; 701/103–107, 110
See application file for complete search history.

(56) References Cited

U.S. PATENT DOCUMENTS

| | | | |
|---|---|---|---|
| 7,676,318 | B2 | 3/2010 | Allain |
| 10,371,071 | B2 * | 8/2019 | Dahodwala ..... F02D 41/1454 |
| 2013/0081444 | A1 | 4/2013 | Vartia et al. |

* cited by examiner

*Primary Examiner* — Hai H Huynh
(74) *Attorney, Agent, or Firm* — Dinsmore & Shohl LLP

(57) ABSTRACT

A soot control system for an internal combustion engine includes an internal combustion engine with a plurality of cylinders. A plurality of engine operating condition sensors are provided. An electronic control unit (ECU) with one or more processors and a non-transitory computer-readable medium storing computer-executable instructions, includes a Gaussian process model. The ECU is configured to receive data from the plurality of engine operating condition sensors. The ECU is configured to calculate a soot parameter of an actual air fuel ratio and calculate a soot parameter of a desired air fuel ratio using the Gaussian process model with the engine operating condition data as input to the Gaussian process model and compare the soot parameter of an actual air fuel ratio and a soot parameter of a desired air fuel ratio to generate a soot offset value.

11 Claims, 5 Drawing Sheets

TRANSIENT SOOT MODEL SYSTEM AND CONTROL PROCESS

FIELD OF THE TECHNOLOGY

The present specification generally relates to combustion control of internal combustion engines and, more specifically, to combustion control of internal combustion engines for soot under transient operation.

BACKGROUND

Soot emissions from diesel engines during transient operation can be significantly higher compared to steady-state measurements. Turbocharged diesel engines suffer from poor transient performance, mostly at low loads and speed conditions, which leads to increased soot emissions. Although the fuel system responds rapidly to the increased fueling demand after a load or speed increase, the turbocharger needs a few engine cycles to meet the higher airflow requirements due to the inertia of the turbocharger system. The low air fuel ratio during the early cycles of a transient event leads to increased soot emissions. Accordingly, a need exists for improved combustion control strategies, systems and methods for soot emission predictions during transient operating conditions.

SUMMARY

In one aspect there is disclosed a soot control system for an internal combustion engine. The system includes an internal combustion engine with a plurality of cylinders. A plurality of engine operating condition sensors are configured to sense engine operating conditions of the internal combustion engine. An electronic control unit (ECU) with one or more processors and a non-transitory computer-readable medium storing computer-executable instructions, the computer-executable instructions includes a Gaussian process model. The ECU is configured to receive engine operating condition data from the plurality of engine operating condition sensors sensing engine operating conditions of the internal combustion engine. The ECU is configured to calculate a soot parameter of an actual air fuel ratio and calculate a soot parameter of a desired air fuel ratio using the Gaussian process model with the engine operating condition data as input to the Gaussian process model and compare the soot parameter of an actual air fuel ratio and a soot parameter of a desired air fuel ratio to generate a soot offset value.

In another aspect there is disclosed, a method for controlling soot of an internal combustion engine comprising the steps of: operating an internal combustion engine, the internal combustion engine having a plurality of engine operating condition sensors configured to sense engine operating conditions, and an electronic control unit (ECU) with one or more processors and a non transitory computer-readable medium storing computer-executable instructions, the computer-executable instructions comprising a Gaussian process model, the ECU configured to receive engine operating condition data from the plurality of engine operating condition sensors sensing engine operating conditions of the internal combustion engine; calculating an actual air fuel ratio; providing the actual air fuel ratio, engine speed, engine torque, rail pressure and SOI to the Gaussian process model and calculating a soot model output based on the actual air fuel ratio; calculating a desired air fuel ratio; providing the desired air fuel ratio, engine speed, engine torque, rail pressure and SOI to the Gaussian process model and calculating a soot model output based on the desired air fuel ratio; and determining a soot offset value based upon a difference between the soot model output based on the desired air fuel ratio and the soot model output based on the actual air fuel ratio.

Additional features and advantages of the apparatuses for holding and retaining glassware during processing described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Systems and methods for soot emissions transient soot for internal combustion engines are provided. Soot emissions from diesel engines during transient operation can be significantly higher compared to steady-state measurements. Turbocharged diesel engines suffer from poor transient performance, mostly at low loads and speed conditions, which leads to increased soot emissions. Although the fuel system responds rapidly to the increased fueling demand after a load or speed increase, the turbocharger needs a few engine cycles to meet the higher air flow requirements due to the inertia of the turbocharger system. The lower air fuel ratio during the early cycles of a transient event leads to increased soot emissions. The transient soot model disclosed herein supplements the ECU's steady state soot model map by providing real time transient corrections based on the operating cycle.

Figure 1:
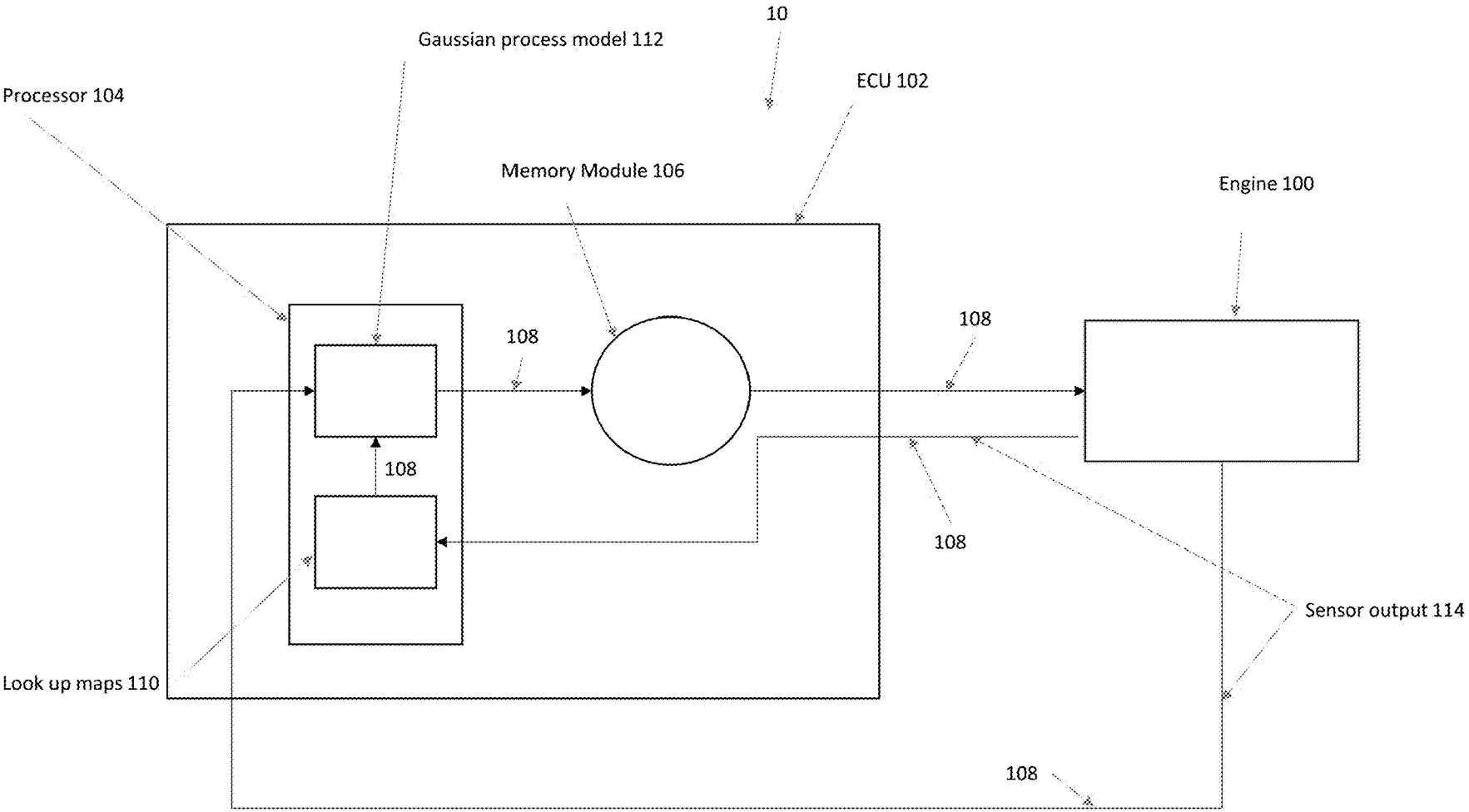
FIG. 1 schematically depicts a system for control of an internal combustion engine according to one or more embodiments disclosed and described herein.

Referring to FIG. 1, an internal combustion engine with a plurality of cylinders and associated fuel injectors has a plurality of sensors that sense and provide data on engine operating conditions (labeled "Sensor Ouput" in the figure) to a Gaussian process model. The Gaussian process model uses the data on the engine operating conditions to calculate and provide a soot offset parameter.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

As used herein, the singular forms "a," "an" and "the" include plural referents unless the context clearly dictates otherwise. Thus, for example, reference to "a" component includes aspects having two or more such components, unless the context clearly indicates otherwise. The term "associated with" refers to a component that is coupled to and necessary for the operation of a different component. The term engine refers to internal combustion engine and ICE.

FIG. 1 generally depicts a system 10 for soot emissions control of an internal combustion engine (ICE) according to one or more embodiments disclosed herein. The system 10 may include a diesel or dual fuel ICE 100. Still referring to FIG. 1, a plurality of engine operating condition sensors may be included to send sensor output 113 to an ECU 102.

The ECU 102 has one or more processors 104, one or more memory modules 106, and other components. Each of the one or more processors 104 may be a controller, an integrated circuit, a microchip, or any other computing device. The one or more memory modules 106 may be non-transitory computer-readable medium and be configured as RAM, ROM, flash memories, hard drives, and/or any device capable of storing computer-executable instructions such that the computer-executable instructions can be accessed by the one or more processors 104. The computer-executable instructions can comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into computer-executable instructions and stored on the one or more memory modules 106. Alternatively, the computer-executable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

The one or more processors 104 can be coupled to the communication path(s) 108 that provide signal interconnectivity between various modules of the system 10. Accordingly, the communication path(s) 108 can communicatively couple any number of processors with one another, and allow the modules of the system 10 to operate in a distributed computing environment. Specifically, each of the modules can operate as a node that may send and/or receive data. As used herein, the term "communicatively coupled" means that coupled components are capable of exchanging data signals with one another such as, for example, electrical signals via conductive medium, over-the-air electromagnetic signals, optical signals via optical waveguides, and the like. Accordingly, the communication path(s) 108 can be formed from any medium that is capable of transmitting a signal such as, for example, conductive wires, conductive traces, optical waveguides, or the like. Moreover, the communication path(s) 108 can be formed from a combination of mediums capable of transmitting signals. In embodiments, the communication path(s) 108 may include a combination of conductive traces, conductive wires, connectors, and buses that cooperate to permit the transmission of electrical data signals to components such as processors, memories, sensors, input devices, output devices, and communication devices. Accordingly, the communication path(s) 108 may include a vehicle bus, such as for example a LIN bus, a CAN bus, a VAN bus, and the like. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium.

The ECU 102 includes look up maps or tables 110 and a Gaussian process model 112, which will be discussed in more detail below.

Figure 2:
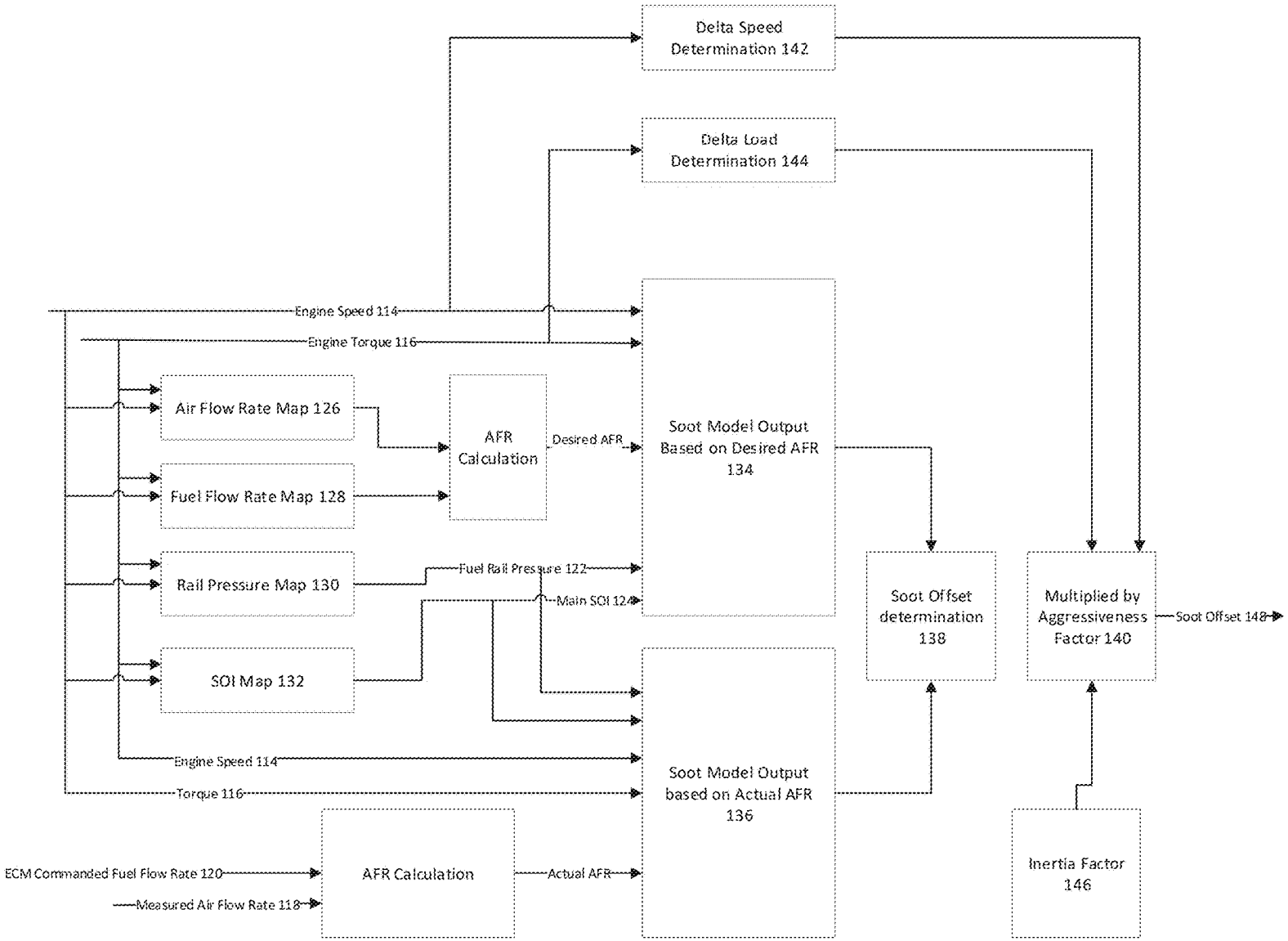
FIG. 2 schematically depicts the system shown in FIG. 1.

Referring to FIG. 2, there is depicted the Gaussian process model and sensor inputs utilized in the system and process of the soot model. The sensor inputs include: engine speed 114, engine torque 116, air flow rate 118, fuel flow rate 120, rail pressure 122, and start of ignition (SOI) 124. The air flow rate 118, fuel flow rate 120, rail pressure 122, and start of ignition (SOI) 124 and provided in a map or table embodied in the ECU as discussed above.

The Gaussian process model is adapted to provide an output for adjusting or complementing the steady state soot emissions from the engine. At any given time step within a duty cycle, the difference in soot emissions predictions between the actual and desired air fuel ratio (AFR) is computed. The desired AFR is calculated using the air flow data and fuel flow data from the air flow rate map 126 and fuel flow rate map 128 along with the rail pressure and SOI from the rail pressure map 130 and SOI map 132. The desired AFR, engine speed, engine torque are provided to the Gaussian process model to generate a soot model output 134 based on the desired AFR.

An actual AFR is calculated based upon a measured air flow rate 118 and an ECU commanded fuel flow rate 120. The actual AFR, engine speed, engine torque, fuel rail pressure and SOI are provided to the Gaussian process model to generate a soot model 136 output based on the actual AFR.

A difference between the soot values of the actual AFR and desired AFR is then calculated to provide a soot offset determination 138. The value computed in this step is then provided to an aggressive factor block 140. The aggressive factor block receives data relating to the delta speed determination 142, delta load determination 144 and an inertia factor 146 of a turbocharger. Typical values for the speed delta is 200 rpm which results in a multiplier of 2 in the aggressive block. A typical value of the torque delta is 100 Nm which results in a multiplier of 1.5 in the aggressive block. The transient soot offset value 148 is outputted and supplements a steady state soot map embodied in the ECU by providing real time transient corrections based on the operating cycle of the engine.

Referring to FIGS. 1 and 2, in embodiments the internal combustion engine 100 with the plurality of sensors provide engine operating condition data (Sensor Output) via communication path 108 to the ECU 104, and particularly to the one or more memory modules 106. The engine operating condition data is provided as input data for the Gaussian process model which may be stored on one or more of the memory modules 106. The engine operating condition data may include engine speed 114, engine torque 116, air flow rate 118, fuel flow rate 120, rail pressure 122, and start of ignition (SOI) 124. The engine operating condition data is provided to the one or more memory modules 106 and the one or more processors 104 calculate the soot model using the Gaussian process model using the engine operating data as input and can be applied to calculate the soot emissions based on desired or actual AFR.

The Gaussian process model is a statistical model with observations occurring in a continuous domain such as time or space. Every data point in the Gaussian process model is associated with a normally distributed random variable with a finite collection of these random variables having a multivariate normal distribution. The distribution of the Gaussian process model is a joint distribution of the random variables, and as such, is a distribution over functions with a continuous domain such as time or space. In embodiments, the Gaussian process model is in the form of $x=GP(m(x), k(x,x'))$ where $m(x)$ is a mean function and $k(x,x')$ is a covariance function. A Bayesian interference model may be selected to maximize the likelihood of represented data and a linear combination of observed outputs of the Gaussian process model forms a model prediction. By using the Gaussian process model with the systems and methods disclosed and described herein, soot emissions in a transient cycle may be controlled and lessened.

Figure 3:
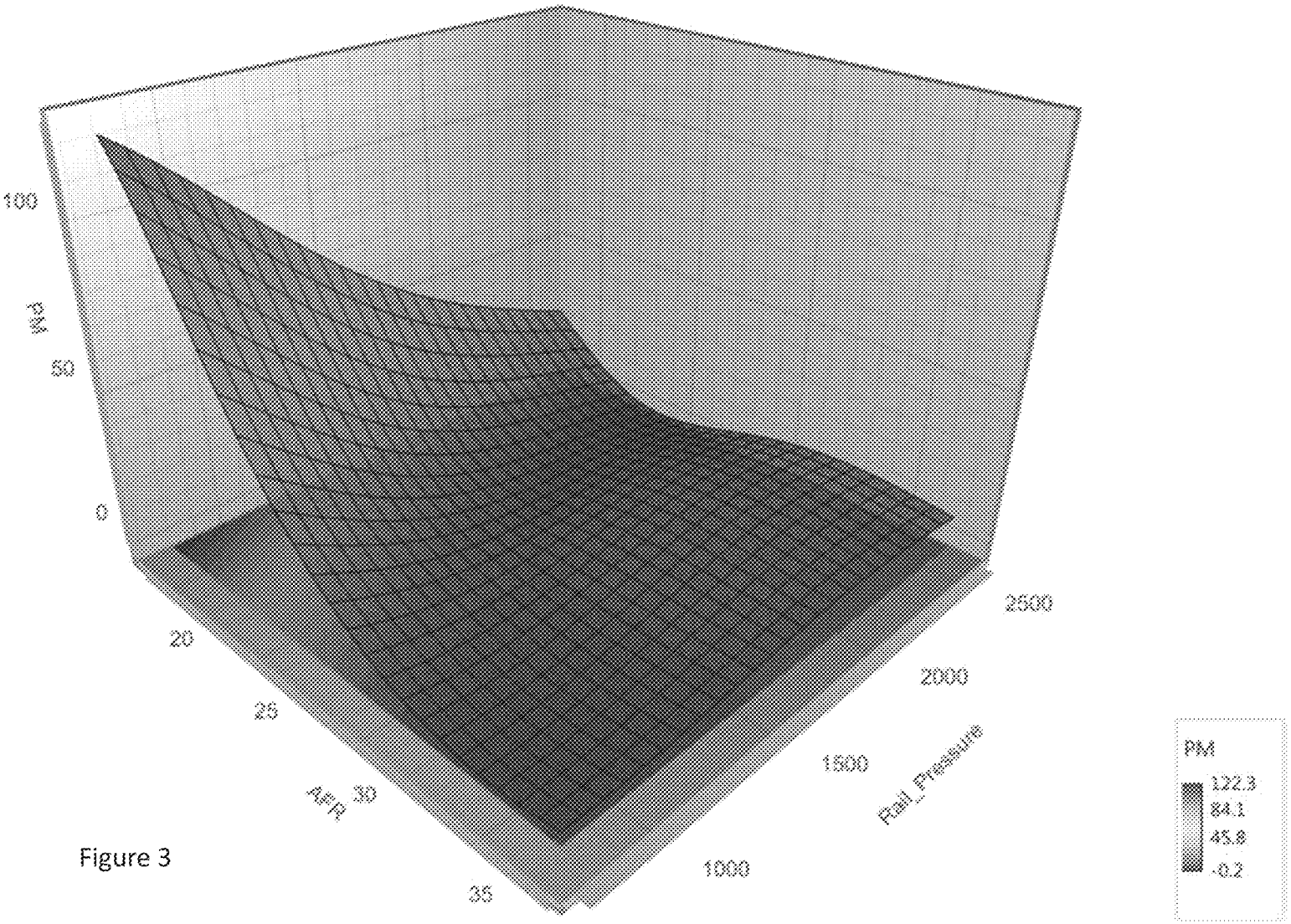
FIG. 3 graphically depicts a gaussian model data set used for a system and method according to one or more embodiments disclosed and described herein.

Referring to FIG. 3, there is shown a graphical depiction of the Gaussian process model which includes the inputs of the engine speed 114, engine torque 116, air flow rate 118, fuel flow rate 120, rail pressure 122, and start of ignition (SOI) 124. The PM value or soot emissions are affected by the air fuel ratio (AFR) and rail pressure as shown in the figure.

In order to better explain the systems and methods disclosed and described herein and yet not limit the scope of the application in any manner, one or more examples are described below.

EXAMPLES

Figure 4:
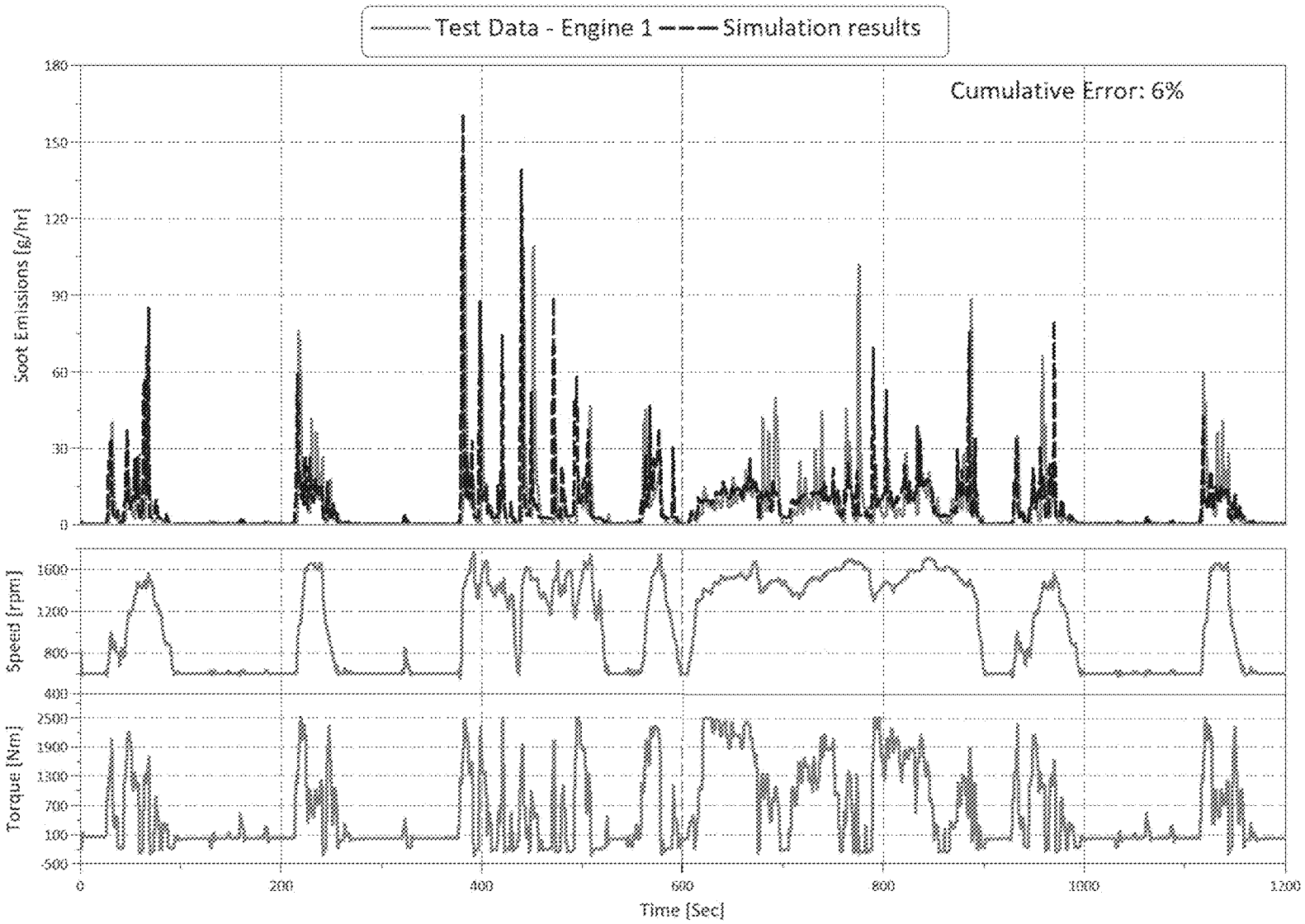
FIG. 4 graphically depicts test data on a first heavy-duty engine.
Figure 5:
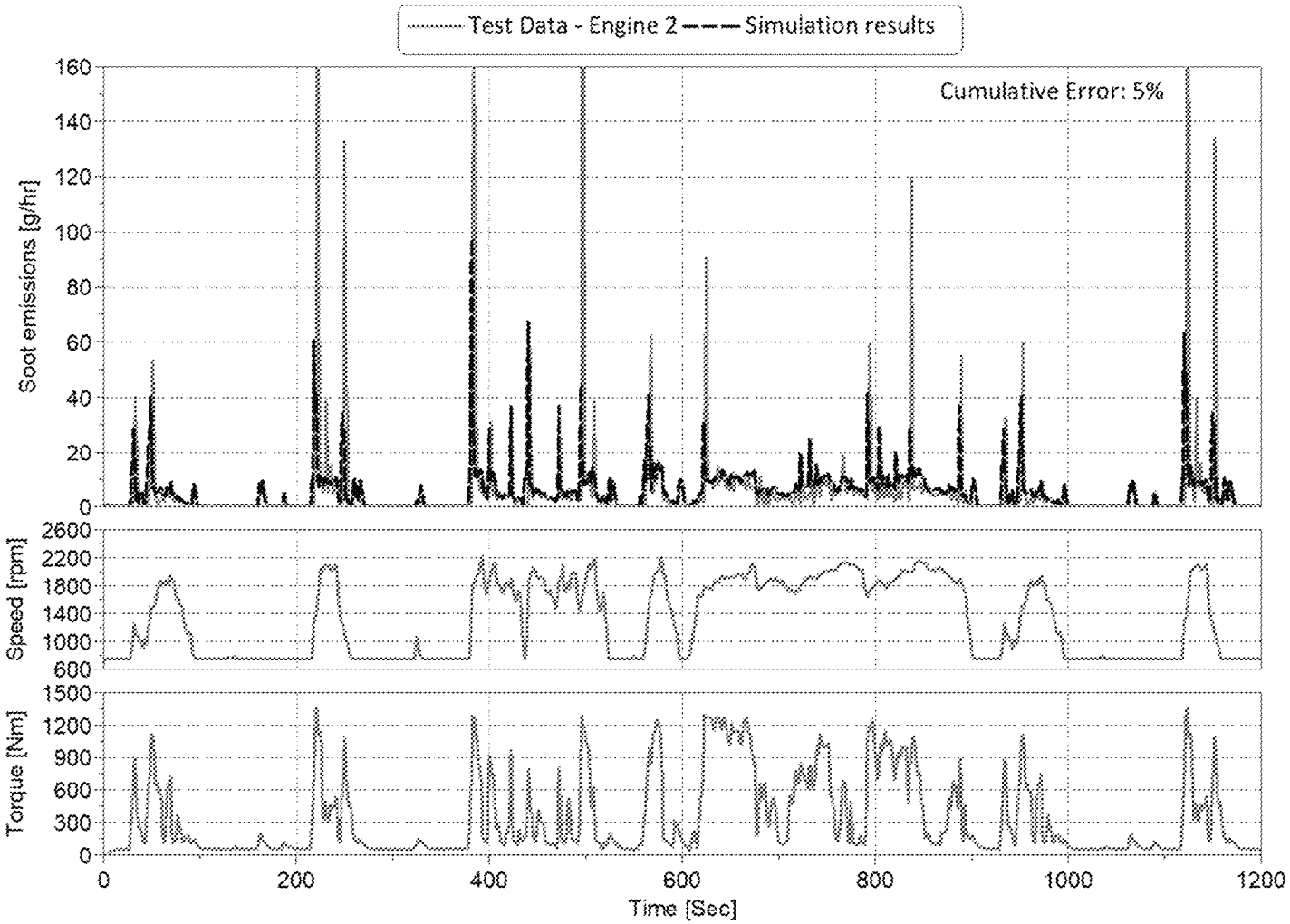
FIG. 5 graphically depicts test data on a second heavy-duty engine.

With reference to FIGS. 4-5, a transient soot control system was developed for an ICE. The development of the system included obtaining engine operating condition data for two different engines. The data from the Gaussian model was compared to the EPA Federal Test Procedure (FTP) cycle test data from two different engines under varying speed and torque operating conditions. As can be seen in the graph, the dashed simulation results closely corresponds to the FTP cycle test data under varying or transient operating conditions. The cumulative error for the engine evaluated in FIG. 4 was 6% while the cumulative error for the engine evaluated in FIG. 5 was 5%.

Accordingly, the systems and methods disclosed and described herein provide for accurate soot predictions and control under transient conditions for ICEs. It will apparent to those skilled in the art that various modifications and variations can be made to the embodiments described herein without departing from the spirit and scope. Thus it is intended that the embodiments described herein cover any modifications and variations provided they come within the scope of the appended claims and their equivalents.

We claim:

1. A soot control system for an internal combustion engine comprising:

an internal combustion engine with a plurality of cylinders;

a plurality of engine operating condition sensors configured to sense engine operating conditions of the internal combustion engine;

an electronic control unit (ECU) with one or more processors and a non-transitory computer-readable medium storing computer-executable instructions, the computer-executable instructions comprising a Gaussian process model, the ECU configured to receive engine operating condition data from the plurality of engine operating condition sensors sensing engine operating conditions of the internal combustion engine;

wherein the ECU is configured to calculate a soot parameter of an actual air fuel ratio and calculate a soot parameter of a desired air fuel ratio using the Gaussian process model with the engine operating condition data as input to the Gaussian process model, compare the soot parameter of an actual air fuel ratio and a soot parameter of a desired air fuel ratio to generate a soot offset value, the generated soot offset value is used to control a soot emission of the internal combustion engine during a transient operation.

2. The soot control system of claim 1, wherein the engine operating conditions include engine speed, engine torque, air flow rate, fuel flow rate, rail pressure, and start of ignition (SOI).

3. The soot control system of claim 2, wherein the engine operating conditions of the desired air fuel ratio of air flow rate, fuel flow rate, rail pressure, and start of ignition (SOI) are provided in a map embodied in the ECU.

4. The soot control system of claim 2, wherein the engine operating conditions of the actual air fuel ratio of air flow rate and fuel flow rate are a measured air flow rate and a commanded fuel flow rate from the ECU and the rail pressure, and start of ignition (SOI) are provided in a map embodied in the ECU.

5. The soot control system of claim 1, further including in the ECU an aggressiveness factor calculated from a delta speed determination, a delta torque determination and an inertia factor of an engine turbocharger, the aggressiveness factor applied to the soot offset value.

6. A method for controlling soot of an internal combustion engine comprising the steps of:

operating an internal combustion engine, the internal combustion engine having a plurality of engine operating condition sensors configured to sense engine operating conditions, and an electronic control unit (ECU) with one or more processors and a non transitory computer-readable medium storing computer-executable instructions, the computer-executable instructions comprising a Gaussian process model, the ECU configured to receive engine operating condition data from the plurality of engine operating condition sensors sensing engine operating conditions of the internal combustion engine;

calculating an actual air fuel ratio;

providing the actual air fuel ratio, engine speed, engine torque, rail pressure and SOI to the Gaussian process model and calculating a soot model output based on the actual air fuel ratio;

calculating a desired air fuel ratio;

providing the desired air fuel ratio, engine speed, engine torque, rail pressure and SOI to the Gaussian process model and calculating a soot model output based on the desired air fuel ratio;

determining a soot offset value based upon a difference between the soot model output based on the desired air fuel ratio and the soot model output based on the actual air fuel ratio; and controlling a soot emission of the internal combustion engine during a transient operation based on the determined soot offset value.

7. The method for controlling soot of claim 6 wherein the engine operating conditions of the desired air fuel ratio of air flow rate, fuel flow rate, rail pressure, and start of ignition (SOI) are provided in a map embodied in the ECU.

8. The method for controlling soot of claim 6, wherein the engine operating conditions of the actual air fuel ratio of air flow rate and fuel flow rate are a measured air flow rate and a commanded fuel flow rate from the ECU and the rail pressure, and start of ignition (SOI) are provided in a map embodied in the ECU.

9. The method for controlling soot of claim 6 further including applying to the soot offset value an aggressiveness factor calculated from a delta speed determination, a delta torque determination and an inertia factor of an engine turbocharger.

10. The method for controlling soot of claim 6 wherein when a value for the speed delta is 200 rpm which results in a multiplier of 2 for the aggressiveness factor.

11. The method for controlling soot of claim 6 wherein when a value for the torque delta is 100 Nm which results in a multiplier of 1.5 for the aggressiveness factor.

* * * * *